US008979433B2

(12) United States Patent
Shaw

(10) Patent No.: US 8,979,433 B2
(45) Date of Patent: Mar. 17, 2015

(54) LIQUID CONTAINMENT BERM AND METHOD OF USE

(71) Applicant: Mark D. Shaw, Jacksonville, FL (US)

(72) Inventor: Mark D. Shaw, Jacksonville, FL (US)

( * ) Notice: Subject to any disclaimer, the term of this patent is extended or adjusted under 35 U.S.C. 154(b) by 90 days.

(21) Appl. No.: 13/848,357

(22) Filed: Mar. 21, 2013

(65) Prior Publication Data

US 2013/0259574 A1 Oct. 3, 2013

Related U.S. Application Data

(60) Provisional application No. 61/616,049, filed on Mar. 27, 2012.

(51) Int. Cl.
*E02B 8/00* (2006.01)
*B65D 90/24* (2006.01)

(52) U.S. Cl.
CPC .. *E02B 8/00* (2013.01); *B65D 90/24* (2013.01)
USPC ..... 405/116; 405/107; 405/52

(58) Field of Classification Search
USPC ..... 405/52, 80, 107–110, 114, 116
See application file for complete search history.

(56) References Cited

U.S. PATENT DOCUMENTS

| | | | | |
|---|---|---|---|---|
| 4,765,775 | A * | 8/1988 | Kroger | 405/52 |
| 5,743,674 | A * | 4/1998 | Healy | 405/52 |
| 5,820,297 | A * | 10/1998 | Middleton | 405/52 |
| 6,695,534 | B2 * | 2/2004 | Cain et al. | 405/52 |
| 2007/0207306 | A1 * | 9/2007 | Broughton et al. | 428/304.4 |
| 2009/0068352 | A1 * | 3/2009 | Gibson | 427/195 |
| 2009/0324335 | A1 * | 12/2009 | Fossen et al. | 405/116 |
| 2014/0030022 | A1 * | 1/2014 | Nicholas et al. | 405/52 |

* cited by examiner

*Primary Examiner* — Benjamin Fiorello
*Assistant Examiner* — Kyle Armstrong
(74) *Attorney, Agent, or Firm* — Thomas C. Saitta

(57) ABSTRACT

A liquid containment berm and its method of creation, assembly and use, wherein the berm has one or more interior seal members, a floor member and an outer wall member created by applying an expandable foam polymer along a desired retention or flow control pathway, the foam polymer expanding to form the liquid impermeable outer wall member. The berm is assembled and installed on site about a liquid container.

18 Claims, 3 Drawing Sheets

LIQUID CONTAINMENT BERM AND METHOD OF USE

This application claims the benefit of U.S. Provisional Patent Application Ser. No. 61/616,049, filed Mar. 27, 2012, the disclosure of which is incorporated herein by reference.

BACKGROUND OF THE INVENTION

This invention relates generally to the field of berms, walls, dykes, pools and the like used to retain liquid or to prevent unwanted movement of liquid, particularly in situations where the liquid is a hazardous liquid accidentally released, leaked or spilled from liquid containers or conduits. More particularly, the invention relates to such devices that can be assembled or installed on a solid base surface already supporting liquid containers or conduits.

In many situations it is desirable to have a secondary means for retaining and containing liquid in conjunction with a liquid container, such as a drum, tank, pipeline, piece of machinery, electrical transformer or the like, that is situated on a base surface, especially when the liquid is a hazardous liquid that may pollute or harm the environment. The purpose of the secondary liquid containment means is to capture and retain any liquid that has inadvertently escaped, spilled, leaked, etc. from the liquid container. Many pre-manufactured secondary containment devices, such as for example permanent walls, flexible walled pools, solid polymer berms or the like, are known and used for this purpose. In some circumstances however, it is desirable to provide a liquid containment berm and method of construction of the berm that allows the berm to be constructed, installed or created on site surrounding a liquid container that cannot easily be moved or lifted.

It is an object of this invention to provide a liquid containment berm capable of retaining liquid which may be constructed, assembled, created and installed on site, which meets the containment capacity requirements and further which may be created surrounding an established primary liquid container that is not easily moved or cannot be moved.

SUMMARY OF THE INVENTION

The invention comprises a liquid containment berm, typically installed as a secondary liquid containment system to capture leaks, spillage or the like from a primary liquid container, and the method of installing the berm, wherein the berm is an assembly generally comprising one or more interior seal members, a floor member and an outer wall member. The liquid containment berm assembly is not pre-assembled, but is instead assembled and installed on site. The interior seal member, being a seal member positioned within and interior to the outer wall member, is composed of polymer composition that is applicable on site by spraying, painting, extruding, pouring, etc., and preferably consists of polymer foam that expands upon application, such as a polyurethane foam that is liquid impermeable upon curing. To form the interior seal member, the expandable polymer foam is applied on site by spraying or extruding the polymer foam material from a chemically activated or pressurized container directly onto the base surface and/or floor member over an area adjacent the portion of a liquid container contacting or extending through the base surface. The polymer foam expands laterally and vertically upon application, forming a sealing member several inches in height and bonding to the liquid container and to the base surface and/or floor member, thereby sealing any gaps that may be present in the base surface and sealing any interior edges of the floor member. The outer wall member, i.e., the berm wall member, is formed utilizing an expanding polymer foam applied along one or more paths on the floor member, within, at or extending over the outer perimeter of the floor member so as to contact some of the base surface, wherein the polymer foam expands laterally and vertically to form one or more liquid impermeable outer walls several inches in height and bonded to the floor member or the floor member and base surface in combination. Additional layers or levels of polymer foam may be applied to increase the height and/or thickness of the outer wall member. The outer wall or wall members so created may be in the form of a closed loop when it is desired that liquid be retained within the berm, or the outer wall member may be arranged and oriented so as to direct liquid flow into a drain, into a sump, through a self-baler, through a pump, or the like. The polymer foam may be allowed to take on its natural expansion configuration or, alternatively, forms, molds or shaping and sanding tools may be utilized to form and shape the outer wall members into a desired configuration. With this structure, the interior sealing members serve to divert any liquids leaking or flowing from the liquid container into the interior containment area of the berm defined by the combination of the interior sealing member and outer wall, where the liquid is retained or directed through a chosen flow path.

The floor member is put in place on the base surface prior to application of the expandable polymer foam, the floor member comprising a sheet of liquid impermeable material. The expanded foam outer wall member may be positioned along the edge of the floor member such that a portion of the foam extends beyond the floor member in order to bond with the base surface, the spray foam outer wall may be positioned within the perimeter edges of the floor member such that a portion of the floor member extends beyond the outer wall member, or the floor member may be provided with apertures such that part of the spray foam outer wall extends through the apertures to bond with the base surface. If a single sheet of material is used for the floor member, an opening is created in the middle shaped to match or closely surround the footprint of the bottom of the liquid container, such that the floor member can be dropped over the liquid container, and/or the floor member is provided with slits extending to the outer edge of the floor member, such that the floor member can be slipped across and around the bottom of the liquid container or the support members (e.g., legs) of the liquid container. Alternatively, where a plurality of sheet members is easier or required due to size or configuration of the liquid container means, the edges of the adjoining sheet members may be sealed by known bonding or joining methods or by use of the polymer foam used to form the interior sealing members or outer wall members.

In additional embodiments, an external coating layer may be applied to the berm wall to increase rigidity, provide UV or other environmental protection, produce a desired color, etc. For example, a rubber, polymer or latex coating may be sprayed, extruded, brushed, etc. onto the outer wall member.

In alternative narrative, the invention is a method for containing liquid released from a liquid container having a base configuration, the liquid container being installed on a base surface, the method comprising the steps of positioning a liquid impermeable floor member on the base surface around the liquid container, said floor member having an outer perimeter; creating a liquid impermeable interior seal member between the liquid container and the floor member by applying an expandable polymer foam to the liquid container and the floor member, the polymer foam expanding and curing to adhere to the liquid container and said floor member to form said liquid impermeable interior seal member; creating a liquid impermeable outer wall member by applying the expandable polymer foam onto said floor member, the polymer foam expanding and curing to form said liquid impermeable outer wall member.

In other terms, the invention is A method for containing liquid released from a liquid container installed on a base surface, the method comprising the steps of positioning a liquid impermeable floor member on the base surface around the liquid container itself or support members for the liquid container, said floor member having an outer perimeter, creating an opening in said floor member, creating a slit in said floor member extending from said outer perimeter to said opening; creating a liquid impermeable interior seal member between the liquid container or its support members and the floor member by applying an expandable polymer foam to the liquid container or its support members and the floor member, the polymer foam expanding and curing to adhere to the liquid container or its support members and said floor member to form said liquid impermeable interior seal member, whereby liquid is precluded from entering said opening; sealing said slit by applying the expandable polymer foam onto said slit; creating a liquid impermeable outer wall member by applying the expandable polymer foam onto said floor member, the polymer foam expanding and curing to form said liquid impermeable outer wall member.

In addition, the invention is a liquid containment berm assembled and formed by these methods.

DETAILED DESCRIPTION OF THE INVENTION

With reference to the drawings, the invention will now be described with regard to the preferred and various embodiments, and to the best mode. The invention is a liquid containment berm and its method of on site creation and assembly, wherein the berm comprises in general one or more interior seal members created by applying an expanding polymer foam material along the bottom or base of a liquid container means or on the liquid container support members (e.g., legs), an outer berm or wall member, also created by applying an expandable foam polymer material along a desired pathway, the foam polymer expanding to form the wall itself, and a floor member extending between the interior sealing walls and the outer wall members. The combination of the interior seal members, outer wall member and floor member defines a liquid impermeable liquid containment berm adapted and capable of retaining liquid or directing liquid flow in a controlled manner. The term "liquid container" shall be taken herein to mean any type of liquid container, drum, tank, pipeline, piece of machinery or equipment, electrical transformer, etc. positioned directly on, extending through or supported above a base surface. The term "base surface" shall be taken herein to mean any type of generally horizontal support body, such as a floor, concrete slab, asphalt body, metal expanse, exterior ground surface, gravel, etc., capable and adapted to support a liquid container. The term "base configuration" shall be taken herein to mean the footprint configuration of the liquid container or the support members of the liquid container on the base surface.

Figure 1:
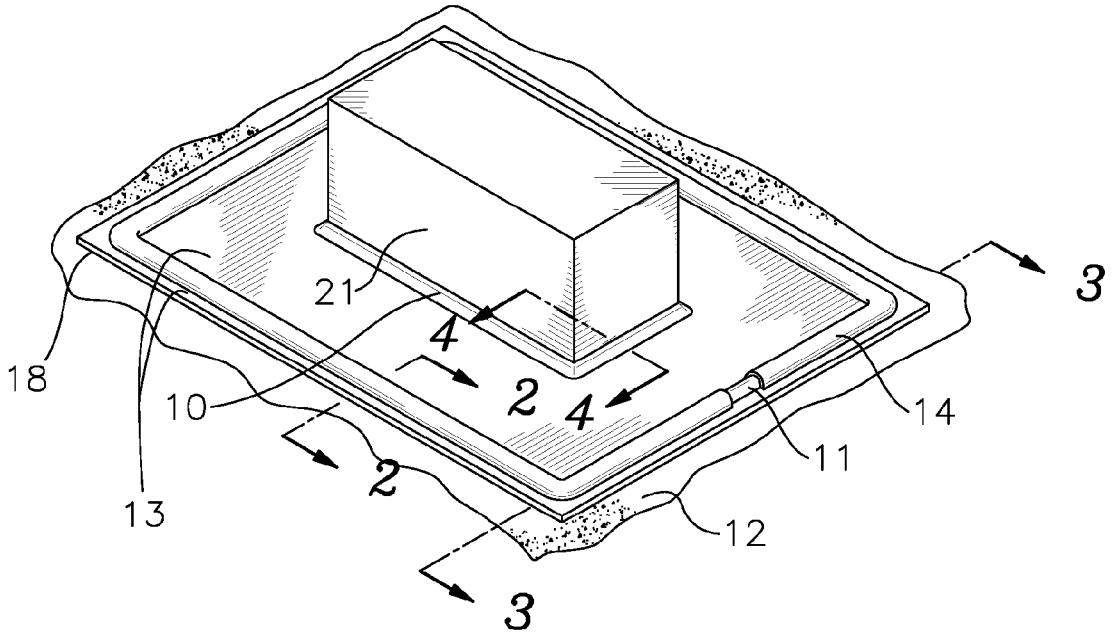
FIG. 1 is a perspective view of an embodiment of the invention in place surrounding a liquid container that is positioned on a base surface, a portion of the coating layer shown as removed to expose the outer wall member.
Figure 4:
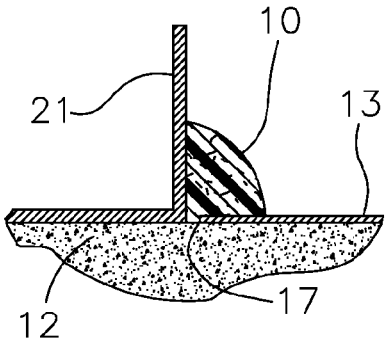
FIG. 4 is a cross-sectional view of the interior seal member taken along line 4-4 of FIG. 1.
Figure 5:
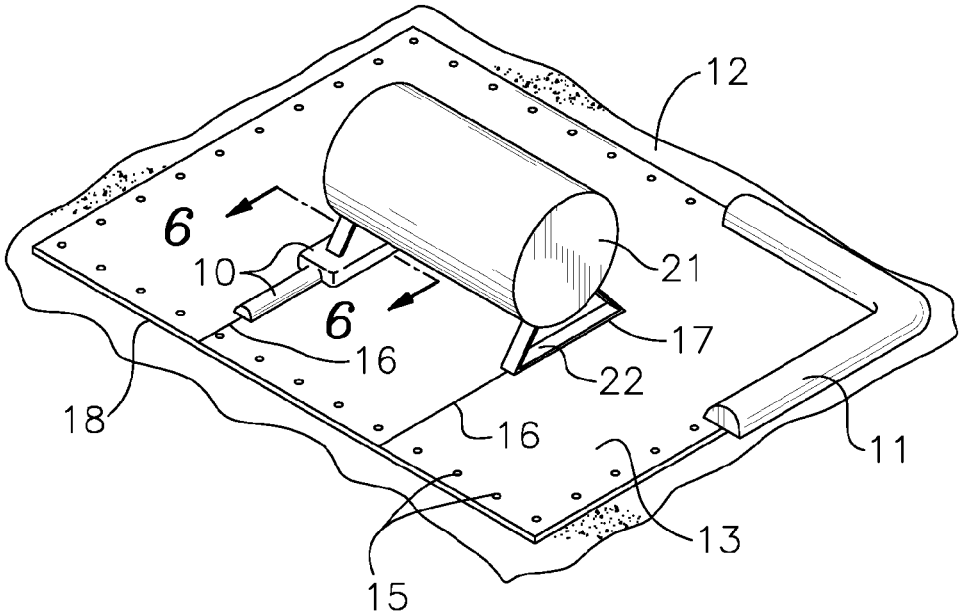
FIG. 5 is a perspective view of another embodiment of the invention, shown as partially installed, wherein the liquid container comprises support members raising a portion of the liquid container above the top surface of the base surface.

To assemble and create the liquid containment berm on site, a floor member 13 is put in place on the base surface 12 prior to creation of the interior seal members 10 and outer wall member 11, the floor member 13 comprising a sheet of liquid impermeable material, such as for example, reinforced PVC or urethane, a copolymer, etc. In certain instances, such as shown in FIG. 1, the floor member 13 may be provided with a centralized opening 17 such that it may be dropped over the liquid container 21 such that the opening surrounds the base of the liquid container 21. In other instances, the floor member 13 may be provided with slits 16 extending to the outer perimeter 18 of the floor member 13, such that the floor member 13 may be slipped laterally across and around the liquid container 21 or its support members 22, as shown in FIG. 5. The slits 16 may be closed and sealed in known manner or sealed and closed utilizing the expandable polymer foam. The floor member 13 may abut the liquid container 21 or its support members 22, or may be sized and configured such that a small area of base surface 12 is exposed between the bottom of the liquid container 21 and the edges of the floor member 13 defining the opening 17, as shown in FIG. 4, such that the expanded polymer foam can adhere to the liquid container 21 or its support members 22, the base surface 12 and the floor member 13, the opening or openings 17 in the floor member 13 being configured so as to substantially match the footprint or base configuration of the liquid container 21 or its support members 22. Apertures 15 may also be disposed along the interior edges of the floor member 13 to allow the material forming the interior seal member 10 to also adhere to the base surface 12. In other instances, multiple sheets of material may be needed to construct the floor member 13 in order to surround a large or multiple liquid containers 21, in which case the edges of the floor member 13 may be overlapped, closed and sealed in known manner or sealed and closed utilizing the expandable polymer foam.

Figure 6:
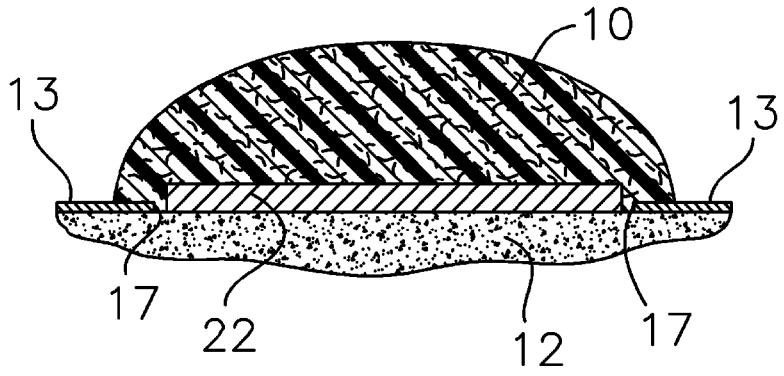
FIG. 6 is a cross-sectional view of the interior seal member taken along line 6-6 of FIG. 5, showing the interior seal member as applied to a support member of the liquid container.

The liquid containment berm further comprises one or more interior seal members 10 composed of a polymer possessing sealing and liquid impermeability characteristics when cured, wherein the polymer is applied on site by any suitable method. Most preferably, the interior seal member 10 is composed of a polymer that expands upon application to form a liquid impermeable expanded polymer foam structure of suitable rigidity upon curing, such as a polyurethane foam, that is applied on site by spraying or extruding the polymer foam material from a chemically activated or pressurized container along the bottom or base of a liquid container 21 positioned directly on a base surface 12, as shown in FIGS. 1 and 4, or on and around the support members 22 (e.g., legs, braces, etc.) of the liquid container 21, as shown in FIGS. 5 and 6. The interior sealing member 10 is applied so as to completely encircle the liquid container 21 or its support members 22 in order to create a full seal. The interior seal member 10 adheres and self-bonds to the liquid container 21 or its support members 22, and also adheres to the floor member 13 or the base surface 12 and floor member 13. The interior seal member 10 forms a liquid impermeable seal several inches in height that directs any liquid flowing or leaking from the liquid container means 21 into the interior containment area of the berm and onto the floor member 13, thereby preventing loss through apertures, conduits, fastener bores, etc. that may be present in the base surface 21. The polymer foam may be allowed to take on its natural expansion configuration or, alternatively, forms, molds or shaping tools may be utilized to shape the interior sealing member 10 into a desired configuration.

Figure 7:
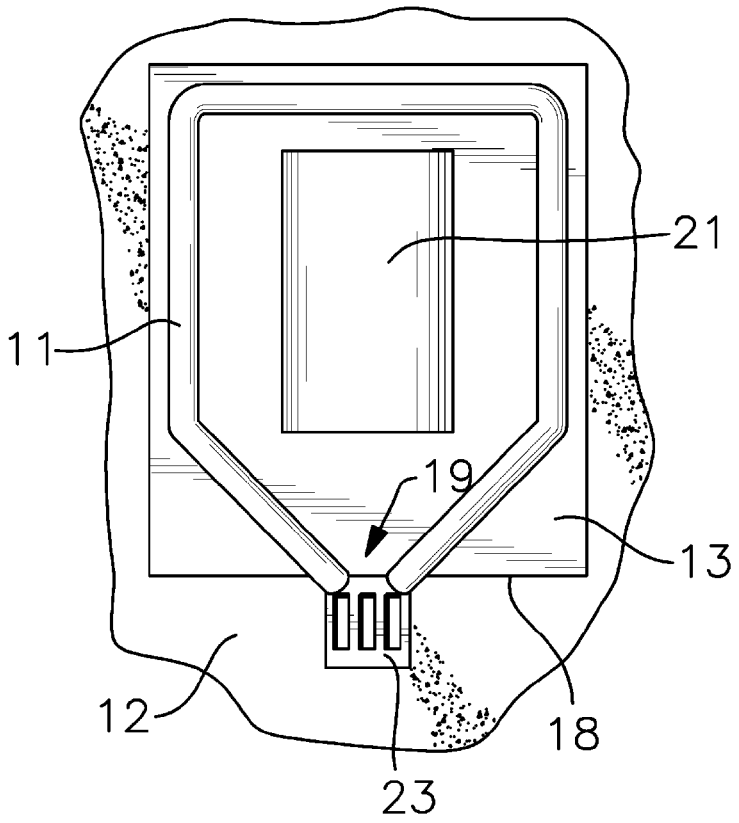
FIG. 7 is a top view of another embodiment of the invention showing the outer wall members positioned to direct liquid flow into a floor drain.

The outer wall member 11 is most preferably composed of an expanded polymer foam material, such as polyurethane, that is applied on site by spraying or extruding the polymer foam material from a chemical or pressurized container either directly on the floor member 13 alone or on both the floor member 13 and the base surface 12, along a path that defines the configuration of the elongated containment or directional outer wall member 11 around the liquid containing 21. The polymer foam expands laterally and vertically, forming a relatively rigid, liquid impermeable wall 11 several inches in height and bonding to the portions of the floor member 13 and base surface 12 to which it is applied. Additional levels of polymer foam may be applied to increase the height and/or width of the outer wall member 11. The outer wall member 11 (or potentially wall members 12 depending on the location of the liquid container 21 relative to other structures or structural features present on the base surface 12) so created may be deposited in the form of a closed loop, such that any liquid is retained within the berm, as shown in FIGS. 1 and 5, or may be configured with a gap 19 to direct or channel liquid flow into a drain 23, sump or the like, as shown in FIG. 7. The polymer foam may be allowed to take on its natural expansion configuration or, alternatively, forms, molds or shaping tools may be utilized to form the outer wall 11 into a desired configuration.

The expanded foam outer wall member 11 may be positioned along the outer perimeter 18 of the floor member 13 such that a portion of the outer wall member 11 extends beyond the floor member 13 in order to also bond with the base surface 12, as shown in FIG. 5, or the expanded foam outer wall member 11 may be positioned completely within the borders of the floor member 13 as shown in FIG. 1. The floor member 13 may be provided with apertures 15 such that part of the expanded foam berm wall 11, and/or the interior seal walls 10, extends through the apertures 15 to bond with the base surface 12, as shown in FIGS. 1-3 and 5.

An example of a water-impermeable expanding foam suitable for on site formation of the inner seal members 10 and the outer wall members 11 is a polymer foam comprising 10-30% sucrose propylene oxide polymer; 10-30% 1,4-benzenedicarboxylic acid, dimethyl ester, manuf. of, by-products from, polymers with diethylene glycol; 10-30% 1,1,12-tetrafluoroethane; 5-10% 1,1,1,3,3-pentafluoropropane; 10-30% tris (1-chloro-2-propyl)phosphate; 1-5% triethyl phosphate; 1-5% 2-ethylhexanoic acid potassium salt; and 1-5% diethylene glycol. Other suitable expanding polymers of differing formulas that cure to form rigid, water impermeable bodies are readily available and known to those of ordinary skill in the art.

Figure 2:
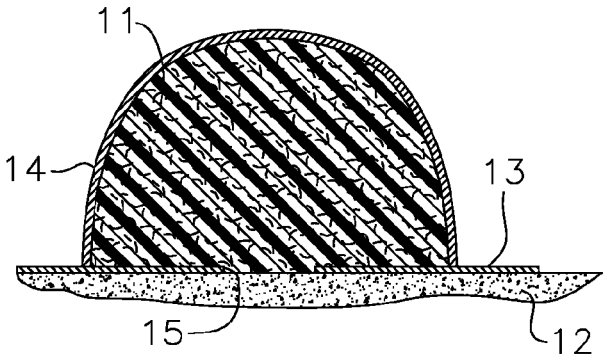
FIG. 2 is a cross-sectional view of the outer wall member taken transversely to the longitudinal axis along line 2-2 of FIG. 1.
Figure 3:
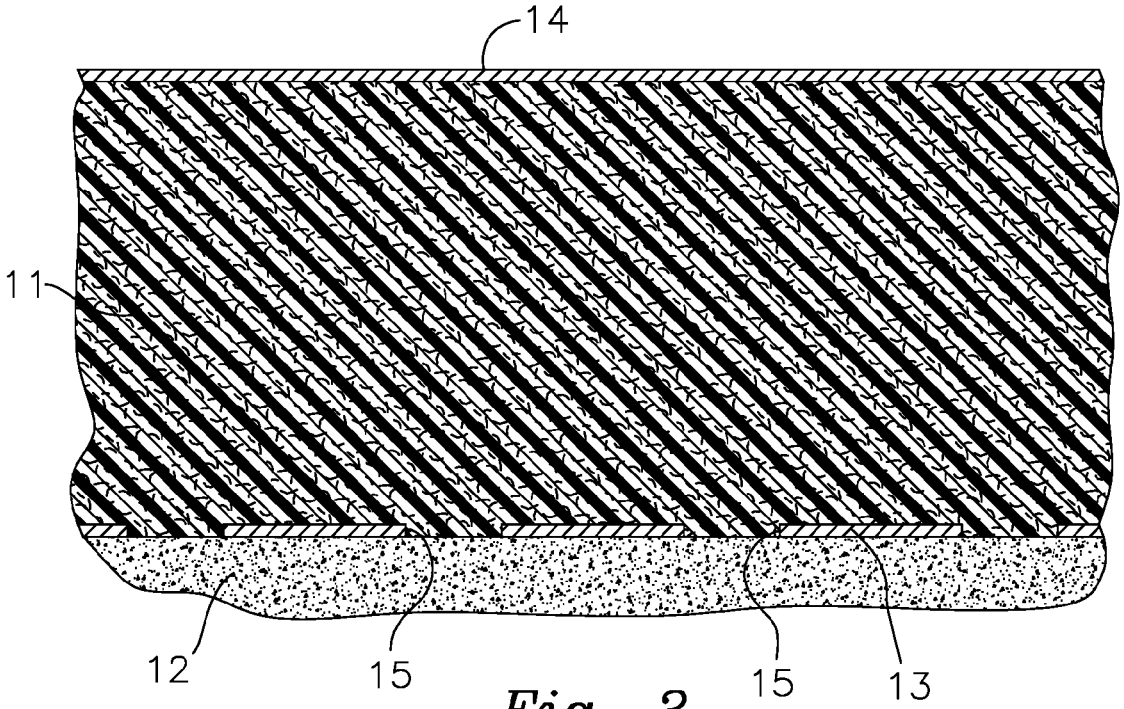
FIG. 3 is a cross-sectional view of the outer wall member taken longitudinally along line 3-3 of FIG. 1.

An external coating layer 14 may be applied to the berm interior seal members 10 or the outer wall member 11, as shown in FIGS. 1-3, to increase rigidity, provide UV or other environmental protection, produce a desired color, etc. For example, a rubber, polymer or latex coating or paint may be sprayed, extruded, brushed, etc. onto the berm wall 11 to form the coating layer 14.

The method of creating, installing and using the liquid containment berm comprising the structural elements previously discussed comprises the steps of providing a suitable liquid impermeable expanding polymer foam material and a liquid impermeable floor member 13, then sizing and cutting the floor member 13 as needed to provide openings 17 or slits 16, such that the floor member 13 may be positioned atop a base surface 12 and surrounding a liquid container 21 supported by support members 22 above the base surface 12, a liquid container 21 extending through a base surface 12, or a liquid container 21 positioned directly on a base surface 12. The location and configuration of the openings 17 or slits 16 are as required to position the interior edges of the openings 17 of the floor member 13 so as to contact the base of the liquid container 21 or its support members 22, or such that the interior edges of the openings 17 of the floor member 13 are adjacent the base of the liquid container 21 or its support members 22 but exposing a portion of the base surface 12. One or more inner seal members 10 are then created by applying the expandable polymer foam around the bottom or base of the liquid container 21 or around and over the support members 22 of the liquid container 21 such that upon expansion and cure the polymer foam abridges or connects the liquid container 21 or support members 22 and the floor member 13, and possibly the base surface 13 if properly exposed, to create an interior seal member 10 that prevents liquid passage through the openings 17 and directs any liquid onto the interior are of the floor member 13. If slits 16 are present they are sealed in known manner or the polymer foam may likewise be applied along the slits 16 to create one or more additional interior seal members 10. Apertures 15 may be provided in the interior portion of the floor member 13 adjacent the openings 17 for the liquid container 21 or its support members 22 or adjacent the outer perimeter 18 of the floor member 13 to allow passage of the polymer foam therethrough such that the cured expanded polymer foam adheres to the base surface 12 as well as the floor member 13. The outer wall member 11 is then created by applying the expandable polymer foam in a pathway or course atop the floor member 13 along a non-apertured area, atop the floor member 13 over the apertures 15 such that a portion of the polymer foam adheres to the base surface 12 as well, or atop and beyond the outer perimeter 18 of floor member 13 such that a portion of the polymer foam adheres to the base surface 12 as well. To retain and contain any liquid within the liquid containment berm, the outer wall member 11 is configured as a closed loop, as shown in FIG. 1. To direct and channel liquid into a desired flow path, such as into a drain 23 for example, the outer wall member is configured with a gap 19, as shown in FIG. 7. Multiple layers may be applied to increase the height or width of the inner seal members 10 or outer wall member 11. An exterior coating layer 14 may be applied to the inner seal members 10 or outer wall member 11 for added protection or aesthetic reasons. The inner seal members 10 or outer wall member 11 may be shaped prior to curing.

It is understood that equivalents and substitutions for certain elements set forth above may be obvious to those of ordinary skill in the art, and therefore the true scope and definition of the invention is to be as set forth in the following claims.

I claim:

1. A method for containing liquid released from a liquid container having a base configuration, the liquid container being installed on a base surface, the method comprising the steps of:

positioning a liquid impermeable floor member on the base surface around the liquid container by creating an opening in said floor member matching the base configuration of the liquid container and dropping said floor member over the liquid container, said floor member having an outer perimeter;

creating a liquid impermeable interior seal member between the liquid container and the floor member by applying an expandable polymer foam to the liquid container and the floor member, the polymer foam expanding and curing to adhere to the liquid container and said floor member to form said liquid impermeable interior seal member;

creating a liquid impermeable outer wall member by applying the expandable polymer foam onto said floor member, the polymer foam expanding and curing to form said liquid impermeable outer wall member.

2. The method of claim 1, wherein said step of creating a liquid impermeable outer wall member comprises configuring said liquid impermeable outer wall member as a closed loop.

3. The method of claim 1, wherein said step of creating a liquid impermeable outer wall member comprises configuring said liquid impermeable outer wall member to comprise a gap.

4. The method of claim 1, wherein said step of positioning a liquid impermeable floor member on the base surface around the liquid container comprises creating a slit in said floor member extending from said outer perimeter to said opening and laterally positioning said floor member around said liquid container.

5. The method of claim 1, further comprising the step of providing apertures in said floor member adjacent said opening, whereby said liquid impermeable interior seal member extends through said apertures to adhere to the base surface.

6. The method of claim 5, further comprising the step of providing apertures in said floor member adjacent said outer perimeter of said floor member, whereby said liquid impermeable outer wall member extends through said apertures to adhere to the base surface.

7. The method of claim 1, further comprising the step of providing apertures in said floor member adjacent said outer perimeter of said floor member, whereby said liquid impermeable outer wall member extends through said apertures to adhere to the base surface.

8. The method of claim 7, wherein said step of creating a liquid impermeable outer wall member comprises applying said expandable polymer foam beyond said outer perimeter of said floor member, whereby said liquid impermeable outer wall member also adheres to the base surface.

9. The method of claim 1, further comprising the step of sizing said opening such that a portion of the base surface is exposed between said floor member and the liquid container, whereby said liquid impermeable interior seal member also adheres to the base surface.

10. The method of claim 1, wherein said step of creating a liquid impermeable outer wall member comprises applying said expandable polymer foam beyond said outer perimeter of said floor member, whereby said liquid impermeable outer wall member also adheres to the base surface.

11. The method of claim 1, further comprising the step of applying coating layer to said outer wall member.

12. The method of claim 1, wherein the liquid container is installed on the base surface with support members, and said step of positioning a liquid impermeable floor member on the base surface around the liquid container comprises positioning the floor member around the support members; and said step of creating a liquid impermeable interior seal member between the liquid container and the floor member comprises applying the expandable polymer foam to the support members of the liquid container and the floor member.

13. The method of claim 12, wherein said step of positioning a liquid impermeable floor member on the base surface around the liquid container comprises creating a slit in said floor member extending from said outer perimeter to said opening and laterally positioning said floor member around said liquid container.

14. A liquid containment berm formed by the method of claim 1.

15. A method for containing liquid released from a liquid container installed on a base surface, the method comprising the steps of:

positioning a liquid impermeable floor member on the base surface around the liquid container itself or support members for the liquid container, said floor member having an outer perimeter, creating an opening in said floor member, creating a slit in said floor member extending from said outer perimeter to said opening, and using said slit and said opening to circumscribe said liquid container with said floor member by dropping said floor member over said liquid container;

creating a liquid impermeable interior seal member between the liquid container or its support members and the floor member by applying an expandable polymer foam to the liquid container or its support members and the floor member, the polymer foam expanding and curing to adhere to the liquid container or its support members and said floor member to form said liquid impermeable interior seal member, whereby liquid is precluded from entering said opening;

sealing said slit by applying the expandable polymer foam onto said slit;

creating a liquid impermeable outer wall member by applying the expandable polymer foam onto said floor member, the polymer foam expanding and curing to form said liquid impermeable outer wall member.

16. The method of claim 15, further comprising the step of providing apertures in said floor member adjacent said outer perimeter of said floor member, whereby said liquid impermeable outer wall member extends through said apertures to adhere to the base surface.

17. The method of claim 15, wherein said step of creating a liquid impermeable outer wall member comprises applying said expandable polymer foam beyond said outer perimeter of said floor member, whereby said liquid impermeable outer wall member also adheres to the base surface.

18. A liquid containment berm formed by the method of claim 16.

* * * * *